US007300193B2

(12) United States Patent
Xie

(10) Patent No.: US 7,300,193 B2
(45) Date of Patent: Nov. 27, 2007

(54) DECORATIVE LIGHTING PRODUCT AND PROCESS OF MAKING

(76) Inventor: Zhiping Xie, Starpress Decorative Lights & Gifts Factory, Xin Yuan Second Street, Xin An Road South, Lu Dong Village, Hu Men Town, Dongguan City, Guangdong Province (CN) 523920

( * ) Notice: Subject to any disclaimer, the term of this patent is extended or adjusted under 35 U.S.C. 154(b) by 5 days.

(21) Appl. No.: 11/196,006

(22) Filed: Aug. 3, 2005

(65) Prior Publication Data

US 2006/0078270 A1 Apr. 13, 2006

Related U.S. Application Data

(63) Continuation-in-part of application No. 10/964,951, filed on Oct. 13, 2004, now abandoned.

(30) Foreign Application Priority Data

Mar. 15, 2005 (CN) ..... 200510054946

(51) Int. Cl.
*F21V 7/04* (2006.01)

(52) U.S. Cl. ..... 362/605; 362/613; 362/632

(58) Field of Classification Search ..... 385/137; 29/841, 856, 858; 156/242, 245
See application file for complete search history.

(56) References Cited

U.S. PATENT DOCUMENTS

| | | | | |
|---|---|---|---|---|
| 5,740,296 | A * | 4/1998 | Harris | 385/116 |
| 5,957,564 | A * | 9/1999 | Bruce et al. | 362/84 |
| 6,430,858 | B1 * | 8/2002 | Andre | 40/714 |
| 7,021,785 | B2 * | 4/2006 | Rubin | 362/123 |
| 7,065,910 | B2 * | 6/2006 | Woodruff | 40/544 |
| 7,066,636 | B2 * | 6/2006 | Wu | 362/654 |
| 2002/0126482 | A1 * | 9/2002 | Chen | 362/249 |

* cited by examiner

*Primary Examiner*—Sung Pak
*Assistant Examiner*—Chad H. Smith
(74) *Attorney, Agent, or Firm*—Advantia Law Group; Michael W. Starkweather; Weili Cheng

(57) ABSTRACT

A polyurethane decorative lighting product comprising a casing made of polyurethane material and a lighting source positioned in the casing. By using polyurethane material, this invention greatly simplifies the manufacturing process and increases the production efficiency. In addition, since the material is elastic in nature, the semi-finished products and finished products are not easily broken or cracked from an impact or fall which may occur during transportation. The elastic nature of the material also makes it unnecessary to use special packing materials to meet safety and protection requirements.

2 Claims, 2 Drawing Sheets

DECORATIVE LIGHTING PRODUCT AND PROCESS OF MAKING

This patent application claims priority from Chinese Patent Application Serial No. 200510054946.7 filed on Mar. 15, 2005. This application is also a continuation-in-part (CIP) of U.S. patent application Ser. No. 10/964,951 filed on Oct. 13, 2004 now abandoned.

BACKGROUND

The present invention relates generally to decorative lighting products.

Most current lighting products have casings made of polyethylene(POLY) materials, with an optical fiber positioned inside that provides the light. The following is a conventional process for manufacturing a POLY casing for a decorative lighting product. First, a forming die of a predetermined shape with a depression made of silicon and a forming die casing made of white plaster is prepared. This forming die is easily distorted during the preparation process, thus the cost of manufacture is relatively high. Second, a prepared polymer resin liquid, such as polyethylene, is poured into the forming die. The forming die is manually rotated to evenly mix the polyethylene liquid and a solidifying agent, which has been added, allowing the mixture to flow evenly in the forming die until it solidifies to form an optical fiber casing.

This process requires a lot of manual labor and hence the productivity is rather low. In addition, a large working space is also required since the semi-finished fiber casing needs to be finished to produce a colored painted fiber casing. To install optical fibers into the optical fiber casing, holes must be drilled in the fiber casing at certain locations (e.g using an electric drill) so that optical fibers can then be installed using a guiding tube, a guiding plate, a hook, and other tools. This process is complicated and inefficient.

With respect to packaging, since the optical fiber casing made of a polymer resin is hollow and very fragile, it cannot pass a drop test if it is packed with conventional packing materials. Therefore, a special packing material with greater strength, such as styrofoam, needs to be used to make the inner packing case. This material not only leads to an increased cost, but may also have adverse environmental impacts.

The inventor's invention in U.S. patent application Ser. No. 10/964,951 discloses an optical fiber product with a casing made of polyurethane(PU) material and an optical fiber for lighting which is not fragile and has a considerably simplified production process and improved productivity. However, the optical fiber gave out an insufficient beam, and manual drilling was still necessary. In addition, the working efficiency is not very high since the surfaces of the finished products which are sealed have to be scrapped if the internal chips are damaged and can no longer transmit light.

SUMMARY

To solve the above-mentioned problems, the present invention provides for improved polyurethane lighting products that have a simple production processing method and are easy to maintain.

The invention also provides a kind of production processing method to manufacture polyurethane lighting products simply, rapidly and efficiently.

The improved polyurethane lighting products of the invention comprise a casing made of polyurethane material and a light source which is attached to the casing at predetermined positions, said light source comprising multiple illuminants which are connected through an electric core.

One embodiment of the present invention provides a polyurethane case with holes at predetermined positions for the illuminant to run outward through the casing so that the illuminant can emit light beyond the surface of the casing. Preferably, the holes on the PU casing are made by compression through a die.

Preferably, the illuminants are secured on the hole of the polyurethane casing by means of a knock-down protective button.

On example of such a protective button includes a tunnel which is circular on the top but square on the bottom in order to secure the illuminant. Inside the wall of the hole, there is the notch for the electric wire of the illuminant to enter into the protective button. The illuminants of the present invention can be small-sized bulbs or LED in nature.

The polyurethane casing of the present invention is a hollow structure composed of a front part and a back part, which are bound together as a whole using an adhesive.

The polyurethane lighting product manufacturing process comprises the steps of: 1) preparing a mold having a front half die and a back half die of a predetermined shape; 2) pouring a liquid polyurethane material into the two half dies of the mold and allowing the polyurethane material to solidify to form a front part and a back part; 3) removing the front casing and back casing which are then repaired or touched-up as needed and color painted; 4) making holes in the front casing and the back casing with a die and positioning a light source composed of multiple illuminants into the holes; 5) bonding the two half casings together using an adhesive material.

This invention incorporates soft polyurethane material, and strings of light sources, thus considerably simplifying the manufacturing process and ease of operation. As a result, productivity can be greatly improved. Comparing this invention and the previous technologies; the semi-finished products and finished products won't break or crack when colliding with an object or falling on the ground during transportation and no special packaging is needed to achieve security and protection. The product of this invention provides a good appearance with enhanced brightness of the light source, a clear product profile, an enhanced sense of reality, easy maintenance and a long service life.

BRIEF DESCRIPTION OF THE DRAWINGS

Additional features and advantages of the invention will be apparent from the detailed description which follows, taken in conjunction with the accompanying drawings, which together illustrate, by way of example, features of the invention, and wherein.

Figure 1:
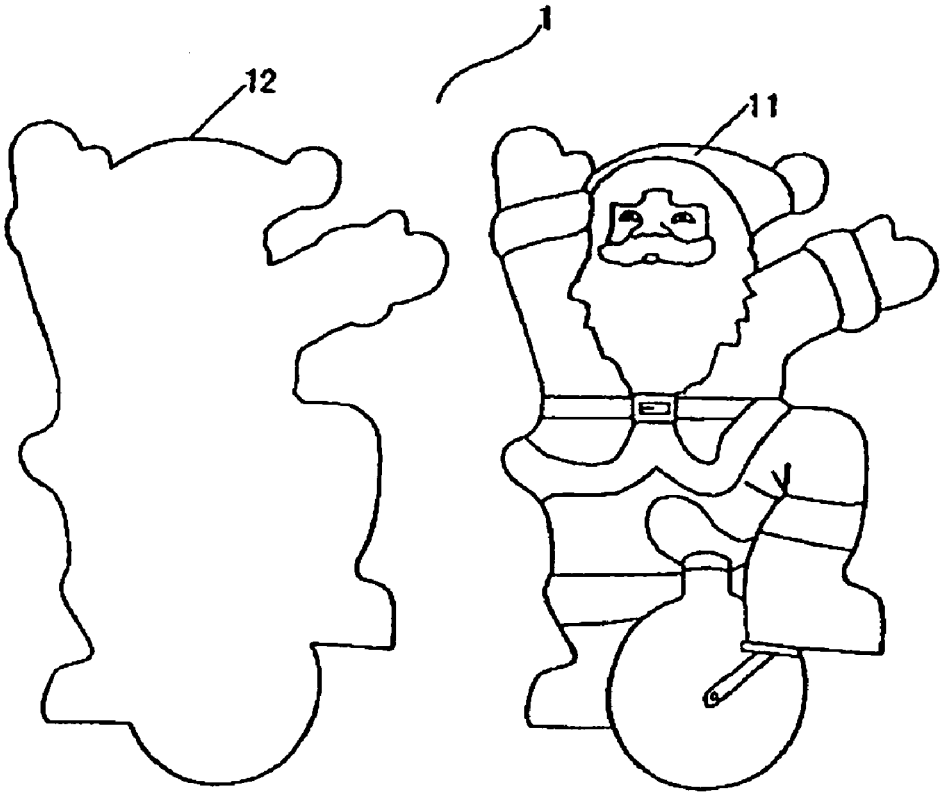
FIG. 1 shows a sketch of the parts of the casing in one embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

This invention is a polyurethane lighting product, including a casing and a light source positioned in the casing. The casing (1), which is hollow, is made of polyurethane material (i.e polyurethane), and consists of a front part (11) and a back part (12) which are bonded together.

The front part (11) of the casing has a predetermined number of holes (13) drilled with the assistance of a die for installation of illuminants (2). The light source is composed of multiple illuminants (2) ((i.e common small light bulbs, colorful festival lights, or LEDs connected via electric wires(3). The illuminants (2) pass through the holes (13) from inside to outside, and are fixed into the holes (13) with a light fastener (4). The light head (21) protrudes out of the casing (1) and gives out a light beam, while the lead (3) connecting the illuminants (2) is inside the casing (1). The illuminants (2) include a removable light head (21) and a square light holder (22). The light fastener (4) is a protective button having a tunnel (41) that is round in the upper part and square in the lower part. The square light holder (22) of the illuminants (2) can be tightly connected inside the tunnel (41), so that the illuminants (2) are fixed and won't rotate. There are slots in the tunnel walls for the electric wires (3) of the illuminants to enter the light fasteners (4). The light head fastener (4) matches the casing hole (13) in size, resulting in a nice appearing product. Meanwhile, the tunnel (41) matches the light holder (22) in size, and the slot (42) offers flexibility to the light head fastener (4). As a result, the parts are tightly connected together, and installation and removal are easy. When an illuminant (2) burns out, it can easily be taken out of the fastener on the surface of the casing (1), and the light head (21) can be changed and then returned to the illuminant, thus making replacement easy for the consumer to performe.

The manufacturing technique of this polyurethane lighting product includes the following steps: 1) preparing a mold having a front half die and a back half die of a predetermined shape; 2) pouring a liquid polyurethane material into the two half dies of the mold and allowing the polyurethane material to solidify to form a front part(11) and a back part(12); 3) removing the front casing and back casing which are then repaired or touched-up as needed, and color painted; 4) making holes in the front casing and the back casing with the help of a die and positioning the light source composed of multiple illuminants into the holes; 5) bonding the two half casings together using an adhesive material.

The products may be manufactured into various shapes in accordance with the actual demands. In this example, it resembles the shape of Santa Claus. However, the invention isn't limited in shape to the said example.

First, a pre-mold is made based on a sculpted model made of clay. The pre-mold is inspected for quality, and then an aluminum alloy die mold is made based on the pre-mold. The aluminum alloy die mold holds its shape and has a long useful life, which reduces costs.

The product is made by assembling two half casings. A polyurethane injection machine is used to inject the proper amount of polyurethane material. One semi-finished product can be completed within 15 minutes. The production efficiency is very high (see Table 1). In addition, the semi-finished product will not break or crack from an impact or fall that may happen during transportation. In normal cases, one worker can make 32~35 sets of semi-finished product in one day using one set of dies. The highest productivity can be achieved with one worker using three sets of dies.

After molding, the dies are removed, and the two half cases, the front part (11) and the back part (12) (as indicated in FIG. 1), can be formed. The half casings are then repaired or touched up as needed, any holes are filled, and the half casing is then color painted into the semi-finished product.

Figure 2:
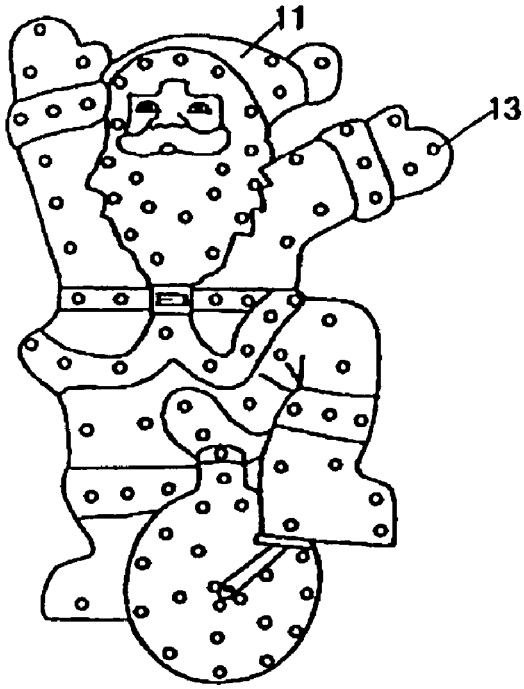
FIG. 2 shows a sketch of the front part of the drilled casing of one embodiment of the present invention.

Holes are made through mold-pressing. Since the PU materials are soft, the hole (13) is made directly by mold-pressing on the appropriate location of the front part (11) or back part (12) of the casing (1). A small number of holes on the side can be drilled manually. The diameter of the hole (13) should be larger than that of the illuminant (2). FIG. 2 illustrates the front part(11) after holes are drilled. This manner of processing saves a lot of labor compared to the former method of manual drilling the holes for optical fiber products. Furthermore, this process improves the work efficiency and reduces the cost.

Figure 3:
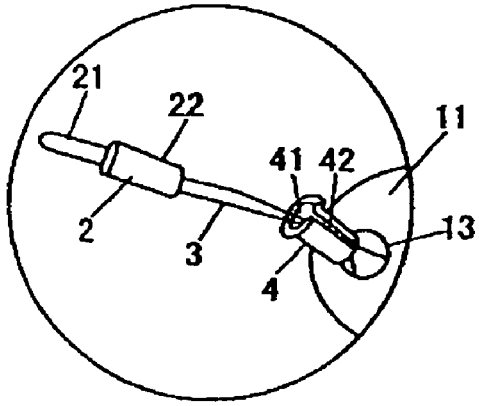
FIG. 3 shows an expanded view of the installation of the light source.
Figure 4:
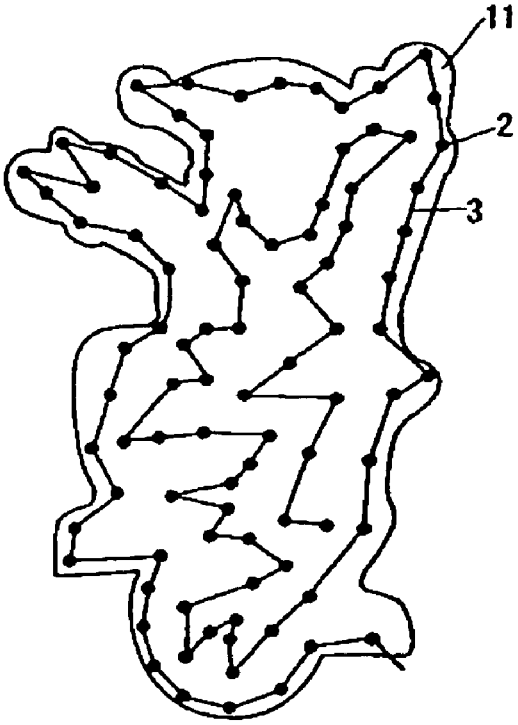
FIG. 4 shows a back view of the casing after the light source has been installed.

The illuminants (2) are installed as indicated in FIG. 3. The illuminants (2) run outward through holes (13) of the front part (11) one by one, then the electric wires(3) connecting the illuminants enter the tunnel (41) through slots (42) of the protective buttons of fastener (4), the protective button is then inserted from outside to inside of the holes (13), and the light holder (22) of the illuminant (2) is then inserted into the tunnel (41) of the protective button (4) to complete securing the light source. When the light source is secured onto the casing, the lighting heads (21) of the illuminants protrude out of the front part (11) of the casing, while the electric wires (3) connecting the illuminants (2) are behind the front part (11) (as indicated in FIG. 4).

Figure 5:
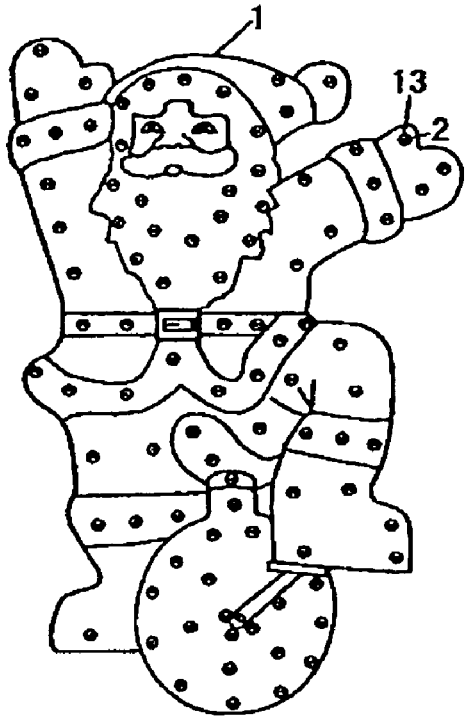
FIG. 5 shows a front view of one embodiment of the present invention.

Adhesives are then pasted on the connection points of the front part (11) and the back part (12) to complete the molding of the products. Minor repair and mending are required to complete production of the entire product. The electric wires (3) of the power connecting illuminant (2) extend out from casing (1). When the power is connected and the illuminant (2) that is secured on the front face (11) of the product illuminates (as indicated in FIG. 5), its decorative properties and attractiveness are increased. Furthermore, it may be connected to a steel support and drive motor, which may allow it to rotate, sway, rise and fall, thus providing vivid images of the lighting.

As for packing, since polyurethane is a kind of foam expanded material that is very flexible and elastic, normal packing will be sufficient for passing a drop test, and product safety can be assured without the use of special packing materials.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A process for manufacturing decorative lighting product, comprising the steps of:

1) preparing a mold having a front half die and a back half die of a predetermined shape;

2) pouring a liquid polyurethane material into the two half dies of the mold and allowing the polyurethane material to solidify to form a front part and a back part;

3) removing the front part and the back part from the mold;

4) making mounting holes on the front part and the back part using a die and positioning a light source comprising multiple illuminants with lighting heads connected by electric wires through the holes;

5) bonding the two half parts together using an adhesive material and installing an electric core configured to power the illuminants;

6) securing the illuminants in the mounting holes by using a removable light fastener comprising a tunnel which is round in the upper part and square in the lower part; said tunnel has a slot in the tunnel walls for the wires connecting to the illuminants to enter the light fastener's tunnel.

2. The process in accordance with claim 1, further comprising the step of painting the front part and back part after removal from the mold.

* * * * *